US010861409B2

(12) United States Patent
Lee et al.

(10) Patent No.: US 10,861,409 B2
(45) Date of Patent: Dec. 8, 2020

(54) DISPLAY DEVICE HAVING A PLURALITY OF DISPLAY REGIONS

(71) Applicant: Samsung Display Co., Ltd., Yongin-si, Gyeonggi-do (KR)

(72) Inventors: Dong Hoon Lee, Yongin-si (KR); Seung Hwan Cho, Yongin-si (KR); Byung Sun Kim, Yongin-si (KR); Jae Hyung Cho, Yongin-si (KR); Jong Hyun Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 147 days.

(21) Appl. No.: 15/892,168

(22) Filed: Feb. 8, 2018

(65) Prior Publication Data

US 2018/0350318 A1 Dec. 6, 2018

(30) Foreign Application Priority Data

May 30, 2017 (KR) ..... 10-2017-0067069

(51) Int. Cl.
*G09G 3/36* (2006.01)
*G09G 5/00* (2006.01)
*G09G 3/20* (2006.01)

(52) U.S. Cl.
CPC ..... *G09G 5/003* (2013.01); *G09G 3/20* (2013.01); *G09G 2300/023* (2013.01);
(Continued)

(58) Field of Classification Search
CPC . G06F 3/038; G09G 5/00; G09G 5/10; G09G 5/003; G09G 5/393; G09G 3/20; G09G 3/30; G09G 3/34; G09G 3/36; G09G 3/3696; G09G 3/3266; G09G 3/3225; G09G 3/3291; G09G 3/32; G09G 3/3611; G09G 3/344; G09G 3/3208; G09G 3/2085; G09G 3/3648; G09G 3/3406; G09G 3/3241; H01L 27/02; H01L 27/15; H01L 27/32; H01L 27/20; H01L 27/12; H01L 27/3248; H01L 27/3276; H01L 27/1225; H01L 27/1255;
(Continued)

(56) References Cited

U.S. PATENT DOCUMENTS 8,976,141 B2 3/2015 Myers et al.
2011/0050975 A1* 3/2011 Chung ..... G06F 1/1624 348/333.02

(Continued)

*Primary Examiner* — Chanh D Nguyen
*Assistant Examiner* — Nguyen H Truong
(74) *Attorney, Agent, or Firm* — Lewis Roca Rothgerber Christie LLP

(57) ABSTRACT

A display device includes a first display region including a plurality of first pixels connected to first scan lines and first data lines, a second display region at one side of the first display region, the second display region including a plurality of second pixels connected to second scan lines and second data lines, a first scan driver configured to supply a scan signal to the first scan lines, a second scan driver between the second display region and the first scan driver, the second scan driver being configured to supply a scan signal to the second scan lines, and a data driver configured to supply a data signal to the first data lines and the second data lines, wherein some of the first scan lines and the second scan lines are at different layers.

17 Claims, 9 Drawing Sheets

(52) U.S. Cl.
CPC ..... *G09G 2300/026* (2013.01); *G09G 2300/0408* (2013.01); *G09G 2300/0426* (2013.01); *G09G 2310/027* (2013.01); *G09G 2310/0232* (2013.01); *G09G 2310/0286* (2013.01); *G09G 2310/0291* (2013.01); *G09G 2310/08* (2013.01); *G09G 2330/023* (2013.01)

(58) Field of Classification Search
CPC ..... H01L 27/1262; H01L 27/1218; H01L 27/124; H01L 27/3267; H01L 33/00; H01L 51/50; H01L 23/3142; H01L 33/36; H03K 17/284; H03K 17/22; H03K 17/687; H03K 17/693; H05K 5/00; H05K 7/00; H05K 7/026; G02F 1/1343; G02F 1/1335; G02F 1/13336; G02F 1/03; G02F 1/136; G02F 1/16; G02F 1/1333; G02F 1/1337; H04N 9/31; H04N 17/00; H04N 17/02
See application file for complete search history.

(56) References Cited

U.S. PATENT DOCUMENTS

2012/0194773 A1* 8/2012 Kim ..... G02F 1/13336 349/139
2013/0321251 A1* 12/2013 Kang ..... G09G 3/36 345/87
2014/0054562 A1* 2/2014 Lee ..... H01L 27/124 257/40
2014/0320479 A1* 10/2014 Kaneko ..... G09G 3/3688 345/212
2016/0111055 A1* 4/2016 Na ..... G09G 3/3666 345/212
2017/0031643 A1* 2/2017 Jeong ..... G06F 3/1446
2017/0309858 A1* 10/2017 Omata ..... G02F 1/0316
2017/0352333 A1* 12/2017 Cheng ..... G09G 5/393
2018/0136947 A1* 5/2018 Choi ..... G06F 9/451

* cited by examiner

DISPLAY DEVICE HAVING A PLURALITY OF DISPLAY REGIONS

CROSS-REFERENCE TO RELATED APPLICATION

This application claims priority to and the benefit of Korean Patent Application No. 10-2017-0067069, filed on May 30, 2017, in the Korean Intellectual Property Office, the entire disclosure of which is incorporated by reference herein.

BACKGROUND

1. Field

Aspects of the present disclosure relate to a display device.

2. Description of the Related Art

In case of some display devices used in smartphones and the like, each display device may have a front display region and one or more side display regions. The one or more side display regions generally display still images such as state messages or touch keys. When the side display regions display still images, only the side display regions are driven at a low frequency, thereby reducing power consumption. A plan for independently driving the front display region and the side display regions is desired.

SUMMARY

According to some aspects of the present disclosure, there is provided a display device including: a first display region including a plurality of first pixels connected to first scan lines and first data lines; a second display region at one side of the first display region, the second display region including a plurality of second pixels connected to second scan lines and second data lines; a first scan driver configured to supply a scan signal to the first scan lines; a second scan driver between the second display region and the first scan driver, the second scan driver being configured to supply a scan signal to the second scan lines; and a data driver configured to supply a data signal to the first data lines and the second data lines, wherein some of the first scan lines and the second scan lines are at different layers.

In some embodiments, each of the first scan lines includes: a first scan line section at a first layer; and a second scan line section at a second layer on the first layer.

In some embodiments, the second scan lines are at the first layer.

In some embodiments, the first scan line section and the second scan line section are electrically connected to each other through a contact opening.

In some embodiments, the second scan line section overlaps with the second scan driver and the second display region.

In some embodiments, the second scan line section overlaps with the first display region.

In some embodiments, the first scan driver and the second driver are at the first layer.

In some embodiments, the first layer includes a buffer layer, an active layer, a gate insulating layer, a gate electrode, a first insulating layer, a source electrode, a drain electrode, the first scan line sections of the first scan lines, and the second scan lines.

In some embodiments, the second layer includes a second insulating layer and the second scan line sections of the first scan lines.

In some embodiments, the display device further includes a controller configured to control the first scan driver and the second scan driver to be driven at different frame frequencies.

In some embodiments, when a low-frequency driving mode is selected, the controller is configured to control the first scan driver to be driven at a first frame frequency, and to control the second scan driver to be driven at a second frame frequency lower than the first frame frequency.

In some embodiments, the low-frequency driving mode is an always on display (AOD) mode in which a still image is always displayed in at least one of the first and second display regions.

In some embodiments, the data driver includes: a first driver corresponding to the first display region; and a second driver corresponding to the second display region.

In some embodiments, a frame frequency of the second driver is synchronized with that of the second scan driver, and the second driver is configured to supply the data signal.

In some embodiments, the second driver includes a buffer connected to the second data lines, wherein, when a low-frequency driving mode is selected, power of the buffer is off at a partial section in one frame.

In some embodiments, the second driver further includes a shift register, a latch, and a digital-analog converter (DAC).

In some embodiments, the display device further includes: a third display region at an other side opposed to the one side of the first display region, the third display region including a plurality of third pixels connected to third scan lines and third data lines; and a third scan driver at the other side of the third display region, the third scan driver being configured to supply a scan signal to the third scan lines.

In some embodiments, the data driver further includes a third driver corresponding to the third display region.

In some embodiments, the display device further includes: a fourth display region between the first display region and the data driver, the fourth display region including a plurality of fourth pixels connected to fourth scan lines and the first data lines; and a fifth display region opposite to the fourth display region, the fifth display region including a plurality of fifth pixels connected to fifth scan lines and the first data lines.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the figures, dimensions may be exaggerated for clarity of illustration. Like reference numerals refer to like elements throughout.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the figures, dimensions may be exaggerated for clarity of illustration.

Hereinafter, exemplary embodiments of the present disclosure will be described in detail with reference to the accompanying drawings.

Figure 1:
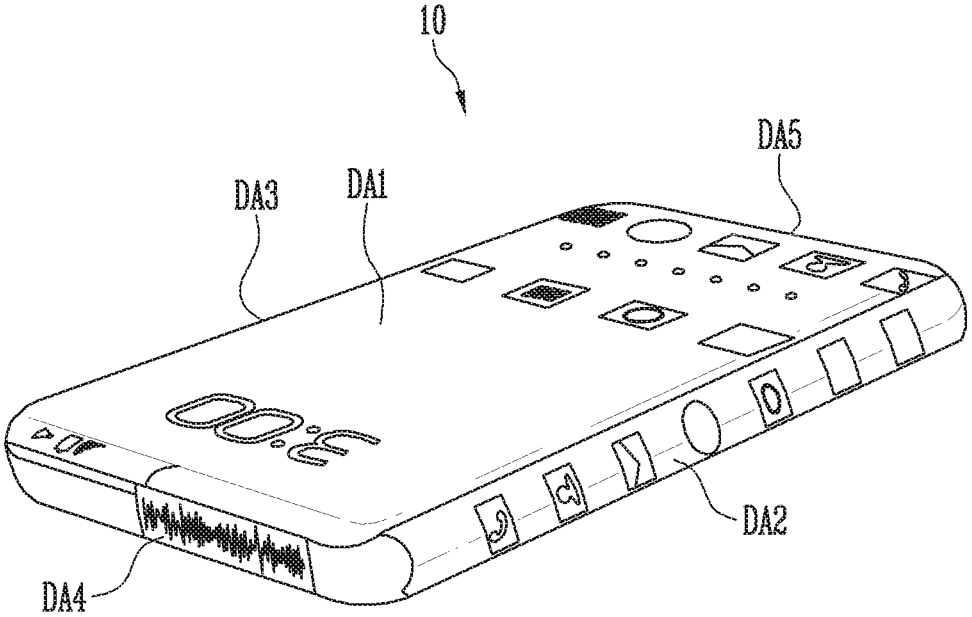
FIG. 1 is a perspective view of a display device according to an embodiment of the present disclosure.

FIG. 1 is a perspective view of a display device according to an embodiment of the present disclosure.

Referring to FIG. 1, the display device 10 according to the embodiment of the present disclosure may include a plurality of display regions DA1 to DA5. Also, the display device 10 may be a solid display device having a polyhedral shape. For example, the display device 10 may be provided in various suitable shapes, such as a tetrahedron, a hexahedron, an octahedron, a polygonal pillar, and the like.

The display regions DA1 to DA5 may be located on any one surface of the display device 10. The display device 10 of this embodiment includes a first display region DA1 located on the front surface thereof, and second to fifth display regions DA2, DA3, DA4, and DA5 located on four surfaces adjacent to the first region DA1. The second to fifth display regions DA2, DA3, DA4, and DA5 have a structure in which they are folded to the four side surfaces. A portion of the whole of the second to fifth display regions DA2, DA3, DA4, and DA5 may be formed in a curved shape having a curvature.

However, the number, shape, and positions of the display regions are illustrative, and may be variously changed in a suitable manner. For example, in another embodiment, the display device may include a display region located on the front surface thereof and two display regions located on both left and right side surfaces.

The display device 10 may be a flexible display device. Because the flexible display device has a property that it is easily curved or deformed by an external force, the flexible display device may be bent or folded to form a polyhedral shape. In addition, the display device 10 may be implemented as a portable terminal such as a smart phone.

The display device 10 may be driven at a low frequency so as to reduce power consumption. A low-frequency driving mode may be selectively performed on some of the display regions DA1 to DA5. In particular, the second to fifth display regions DA2, DA3, DA4, and DA5 located on the side surfaces generally display still images such as state messages or touch keys. When the second to fifth display regions DA2, DA3, DA4, and DA5 display still images, the second to fifth display regions DA2, DA3, DA4, and DA5 are driven at a low frequency, thereby reducing power consumption.

Figure 2:
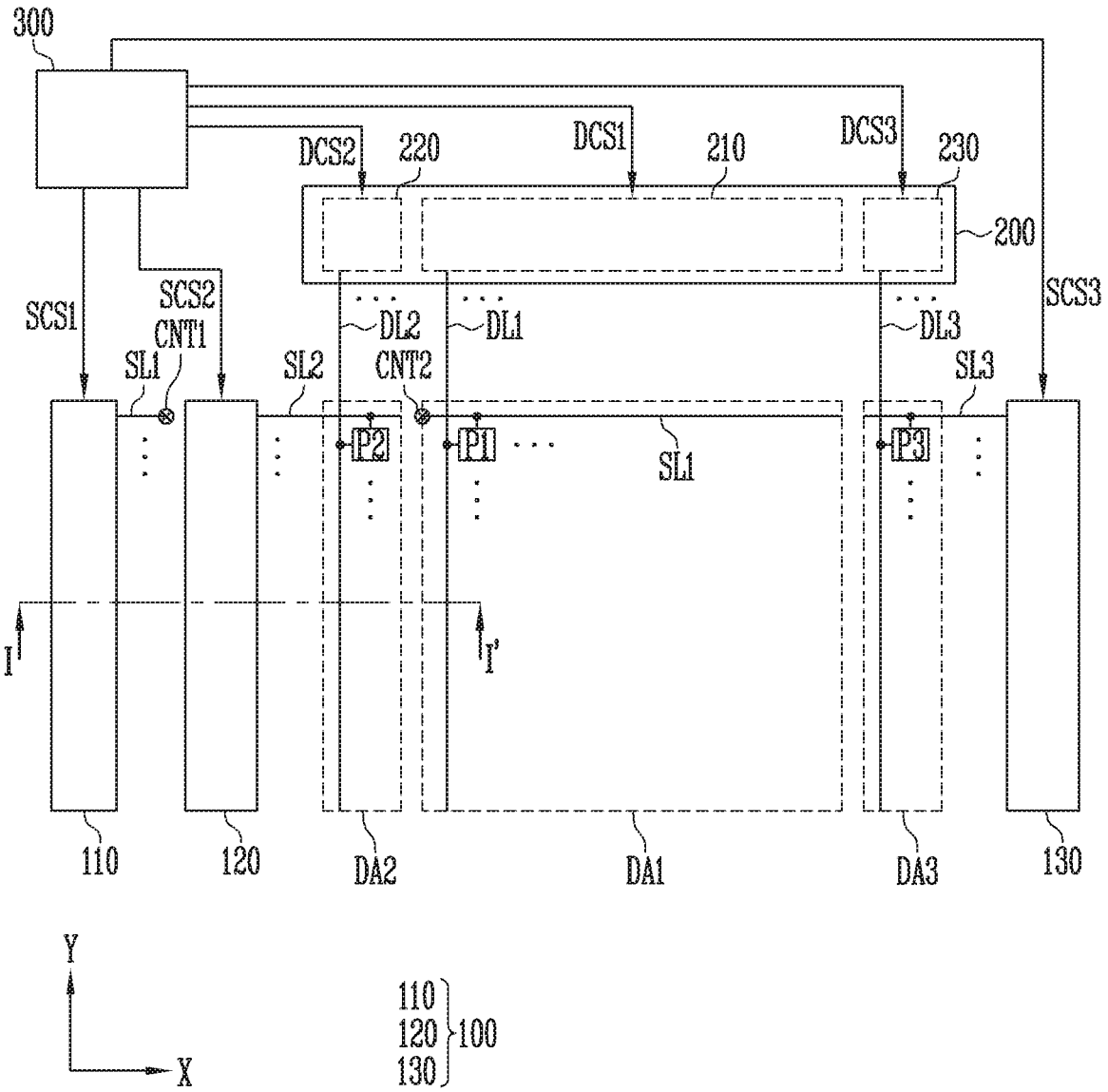
FIG. 2 is a block diagram of a display device according to an embodiment of the present disclosure.

FIG. 2 is a block diagram of a display device according to an embodiment of the present disclosure.

Referring to FIG. 2, the display device according to the embodiment of the present disclosure includes a first display region DA1, a second display region DA2, a third display region DA3, a scan driver 100, a data driver 200, and a controller 300. Here, the scan driver 100 includes a first scan driver 110, a second scan driver 120, and a third scan driver 130.

The first display region DA1 includes a plurality of first pixels P1 connected to first scan lines SL1 formed in an X direction and first data lines DL1 formed in a Y direction intersecting the X direction, the plurality of first pixels P1 being arranged in a matrix form. The first pixels P1 emit light with a luminance corresponding to a data signal supplied to the first data lines DL1 when a scan signal is supplied from the first scan lines SL1. The first pixels P1 may be organic light emitting devices. However, the present disclosure is not limited thereto, and the first pixels P1 may be implemented as various suitable types of devices such as liquid crystal devices, electrophoretic devices, electro-wetting devices, and the like.

The second display region DA2 includes a plurality of second pixels P2 connected to second scan lines SL2 formed in the X direction and second data lines DL2 formed in the Y direction, the plurality of second pixels P2 being arranged in a matrix form. The second pixels P2 may have the same kind (e.g., type) and same or substantially the same structure as the first pixels P1. The second display region DA2 may be located at the left side of the first display region DA1. The X-direction width (i.e., the width along the X direction) of the second display region DA2 may be smaller than the X-direction width of the first display region DA1, and the Y-direction width (i.e., the width along the Y direction) of the second display region DA2 may be equal to the Y-direction width of the first display region DA1.

The third display region DA3 includes a plurality of third pixels P3 connected to third scan lines SL3 formed in the X direction and third data lines DL3 formed in the Y direction, the plurality of third pixels P3 being arranged in a matrix form. The third pixels P3 may have the same kind (e.g., type) and same or substantially the same structure as the first pixels P1. The third display region DA3 may be located at the right side of the first display region DA1. The size of the third display region DA3 may be equal to that of the second display region DA2.

The first scan driver 110 supplies a scan signal to the first scan lines SL1. The first scan driver 110 is connected to the first scan lines SL1, and outputs the scan signal to the first scan lines SL1 in response to a first scan control signal SCS1. In an embodiment, the first scan driver 110 may be configured with a plurality of stage circuits, and sequentially supply the scan signal to the first scan lines SL1. When the scan signal is sequentially supplied to the first scan lines SL1, the first pixels P1 are selected in units of rows.

The second scan driver 120 supplies a scan signal to the second scan lines SL2. The second scan driver 120 is located at the left side of the second display region DA2. The second scan driver 120 is connected to the second scan lines SL2, and outputs the scan signal to the second scan lines SL2 in response to a second scan control signal SCS2. When the scan signal is sequentially supplied to the second scan lines SL2, the second pixels P2 are selected in units of rows.

The third scan driver 130 supplies a scan signal to the third scan lines SL3. The third scan driver 130 is located at the right side of the third display region DA3. The third scan driver 130 is connected to the third scan lines SL3, and outputs the scan signal to the third scan lines SL3 in response to a third scan control signal SCS3. When the scan signal is sequentially supplied to the third scan lines SL3, the third pixels P3 are selected in units of rows.

The data driver 200 supplies a data signal to the first data lines DL1, the second data lines DL2, and the third data lines DL3. The data driver 200 may include a first driver 210 corresponding to the first display region DA1, a second driver 220 corresponding to the second display region DA2, and a third driver 230 corresponding to the third display region DA3.

The first driver 210 outputs a data signal to the first data lines DL1 in response to a first data control signal DCS1 from the controller 300. The second driver 220 outputs a data signal to the second data lines DL2 in response to a second data control signal DCS2 from the controller 300. The third driver 230 outputs a data signal to the third data lines DL3 in response to a third data control signal DCS3.

The controller 300 controls the first to third scan drivers 110, 120, and 130 and the data driver 200. The controller 300 may receive image data and synchronization signals, a clock signal, and the like, which are used to control the display of the image data. The controller 300 may correct image data input from the outside to be suitable for image display, and supply the corrected data to the data driver 200. The controller 300 may output the first to third scan control signals SCS1, SCS2, and SCS3 for respectively controlling the first to third scan drivers 110, 120, and 130. Also, the controller 300 may output the first to third data control signals DCS1, DCS2, and DCS3 for respectively controlling the first to third drivers 210, 220, and 230 of the data driver 200.

The controller 300 may control the first to third scan drivers 110, 120, and 130 to be driven at different frame frequencies. For example, when a low-frequency driving mode is selected, the controller 300 may control the first scan driver 110 to be driven at a first frame frequency, and may control at least one of the second scan driver 120 and the third scan driver 130 to be driven at a second frame frequency lower than the first frame frequency. The low-frequency driving mode may be an always on display (AOD) mode in which a set or predetermined still image is always displayed in at least one display region. In addition, the frame frequency may be variable.

For example, the controller 300 controls the first scan driver 110 to be driven in a normal mode (or a general mode) in which the frame frequency is 60 Hz, and controls the second scan driver 120 and the third scan driver 130 to be driven in the AOD mode in which the frame frequency is 1 Hz. Then, the first scan driver 110 outputs, 60 times for every frame, a scan signal to the first scan lines SL1. In addition, the second scan driver 120 outputs, once for every frame, a scan signal to the second scan lines SL2, and outputs, once for every frame, a scan signal to the third scan lines SL3. Each of the first to third scan control signals SCS1, SCS2, and SCS3 may include a start signal for allowing the output of the scan signal to be started.

The controller 300 may control the first to third drivers 210, 220, and 230 of the data driver 200 to be driven at different frame frequencies. For example, the controller 300 may control the first driver 210 to be driven at the first frame frequency, and control at least one of the second and third drivers 220 and 230 to be driven at the second frame frequency.

According to an example, the first scan driver 110 is driven in the normal mode (or general mode) in which the frame frequency is 60 Hz, and the second scan driver 120 and the third scan driver 130 are driven in the AOD mode in which the frame frequency is 1 Hz. Then, the frame frequency of the first driver 210 is synchronized at 60 Hz such that the first driver 210 outputs, 60 times for every frame, a data signal to the first data lines DL1. In addition, the frame frequency of the second driver 220 is synchronized with 1 Hz such that the second driver 220 outputs, once for every frame, a data signal to the second data lines DL2, and the frame frequency of the third driver 230 is synchronized with 1 Hz such that the third driver 230 outputs, once for every frame, a data signal to the third data lines DL3.

The first scan driver 110 may be located at the left side of the second scan driver 120. Although the second scan driver 120 is located adjacent to the second display region DA2 and the third scan driver 130 is located adjacent to the third display region DA3, the first scan driver 110 is not located adjacent to the first display region DA1.

Because the second scan driver 120 and the second display region DA2 are located between the first scan driver 110 and the first display region DA1, the first scan lines SL1 may overlap with other components. Therefore, at least some of the first scan lines and the second scan lines are disposed in different layers. This will be described in detail later with reference to FIGS. 5A, 5B, and 5C.

Figure 3:
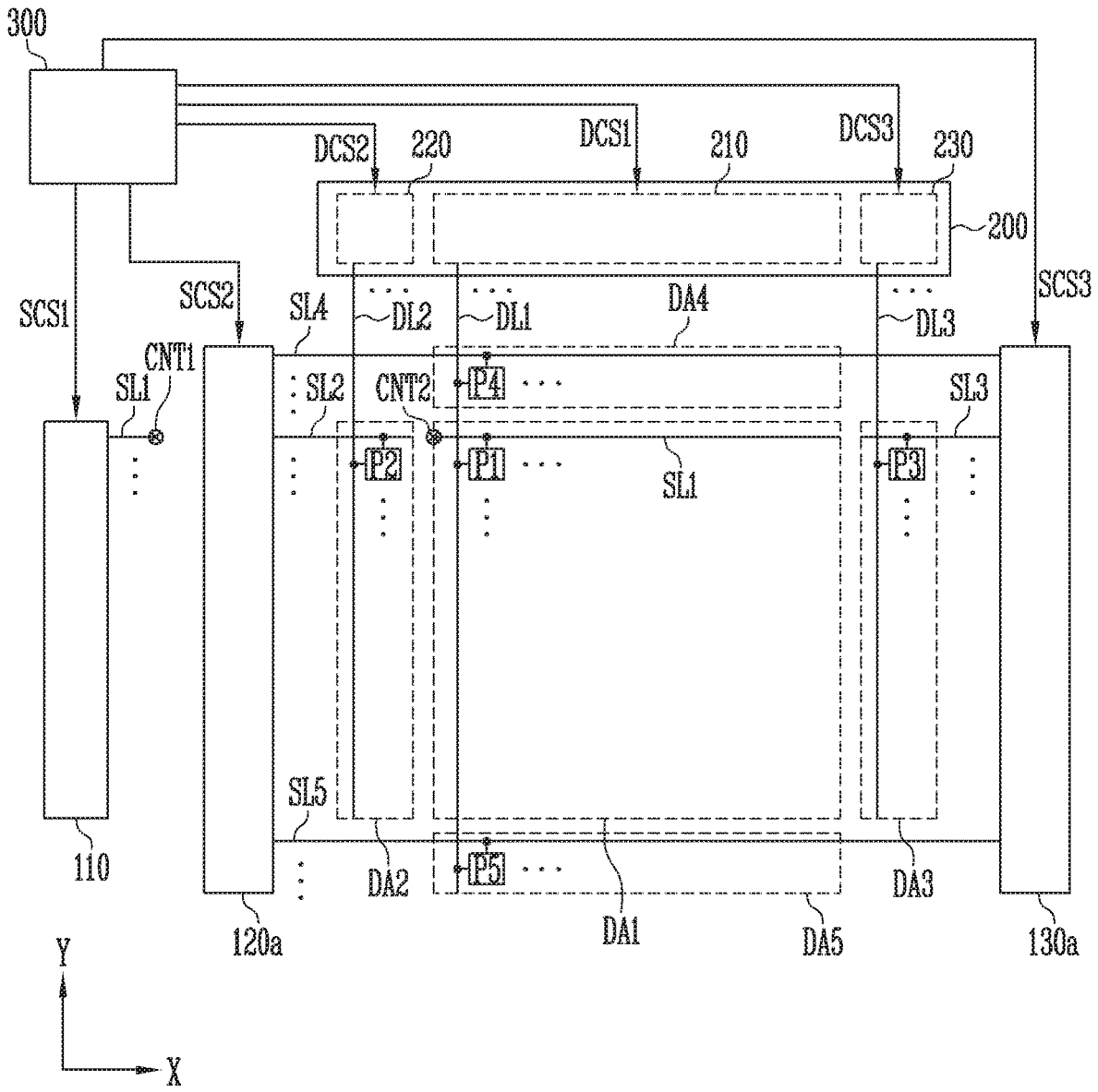
FIG. 3 is a block diagram of a display device according to another embodiment of the present disclosure.
Figure 4:
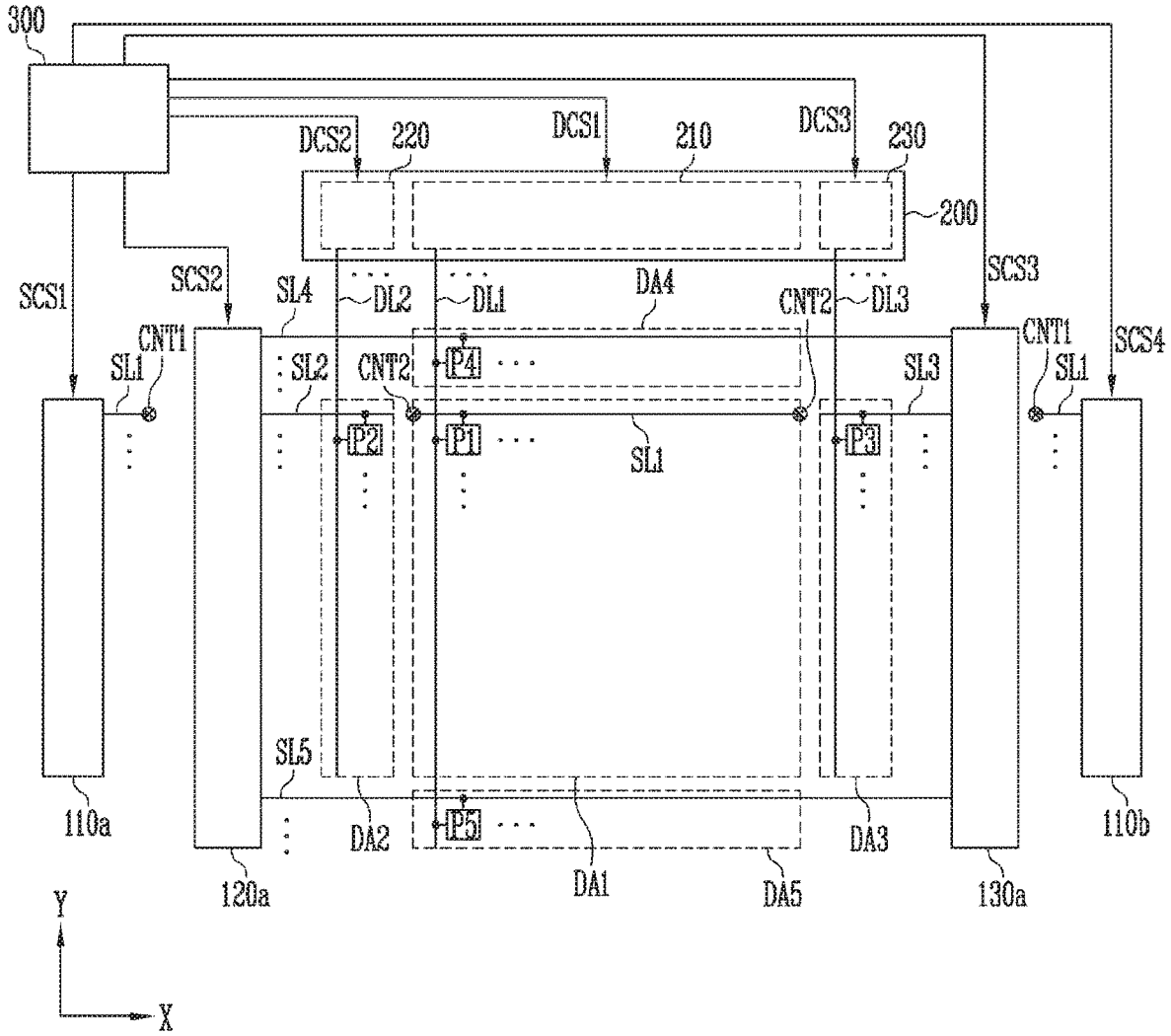
FIG. 4 is a block diagram of a display device according to still another embodiment of the present disclosure.

FIG. 3 is a block diagram of a display device according to another embodiment of the present disclosure. FIG. 4 is a block diagram of a display device according to still another embodiment of the present disclosure.

Hereinafter, descriptions of components substantially identical to those of the above-described embodiment may not be repeated.

Referring to FIG. 3, the display device according to the another embodiment of the present disclosure further includes a fourth display region DA4 and a fifth display region DA5.

The fourth display region DA4 is located at an upper side of the first display region DA1, and includes a plurality of fourth pixels P4 connected to fourth scan lines SL4 parallel to the second scan lines SL2 and the first data lines DL1.

The fifth display region DA5 is located at a lower side of the first display region DA1, and includes a plurality of fifth pixels P5 connected to fifth scan lines SL5 parallel to the second scan lines SL2 and the first data line DL1. The size of the fifth region DA5 may be equal to that of the fourth display region DA4.

In this embodiment, a second scan driver 120*a* supplies a scan signal to not only the second scan lines SL2 but also the fourth scan lines SL4 and the fifth scan lines SL5. The second scan driver 120*a* is configured to independently supply a scan signal to the second display region DA2, the fourth display region DA4, and the fifth display region DA5 in response to the second scan control signal SCS2.

A third scan driver 130*a* supplies a scan signal to not only the third scan lines SL3 but also the fourth scan lines SL4 and the fifth scan lines SL5. The third scan driver 130*a* is configured to independently supply a scan signal to the third display region DA3, the fourth display region DA4, and the fifth display region DA5 in response to the third scan control signal SCS3.

Referring to FIG. 4, the display device according to the still another embodiment of the present disclosure includes two first scan drivers 110*a* and 110*b* so as to reduce delay of scan signals. A left-side first scan driver 110*a* is substantially identical to the first scan driver 110 of the above-described embodiments. A right-side first scan driver 110*b* has the same or substantially the same structure as the left-side first scan driver 110*a*, and is symmetrical to the left-side first scan driver 110*a*. The controller 300 outputs a fourth scan control signal SCS4 identical to the first scan control signal SCS1 such that the first scan drivers 110*a* and 110*b* are driven at the same or substantially the same timing.

Figure 5A:
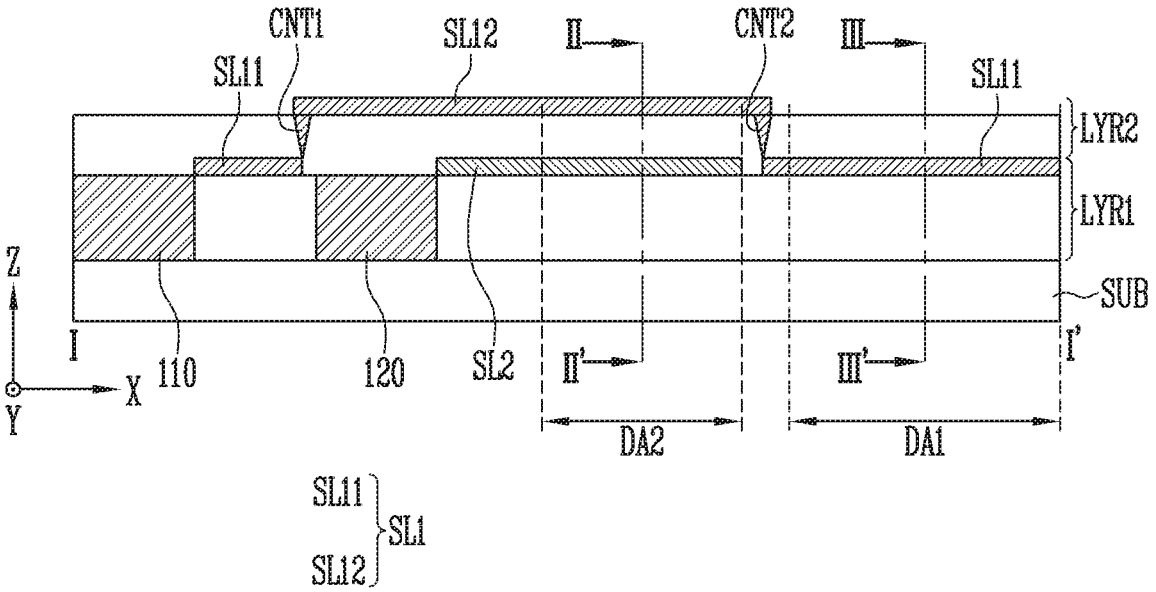
FIG. 5A is a schematic sectional view taken along the line I-I' of FIG. 2.
Figure 5B:
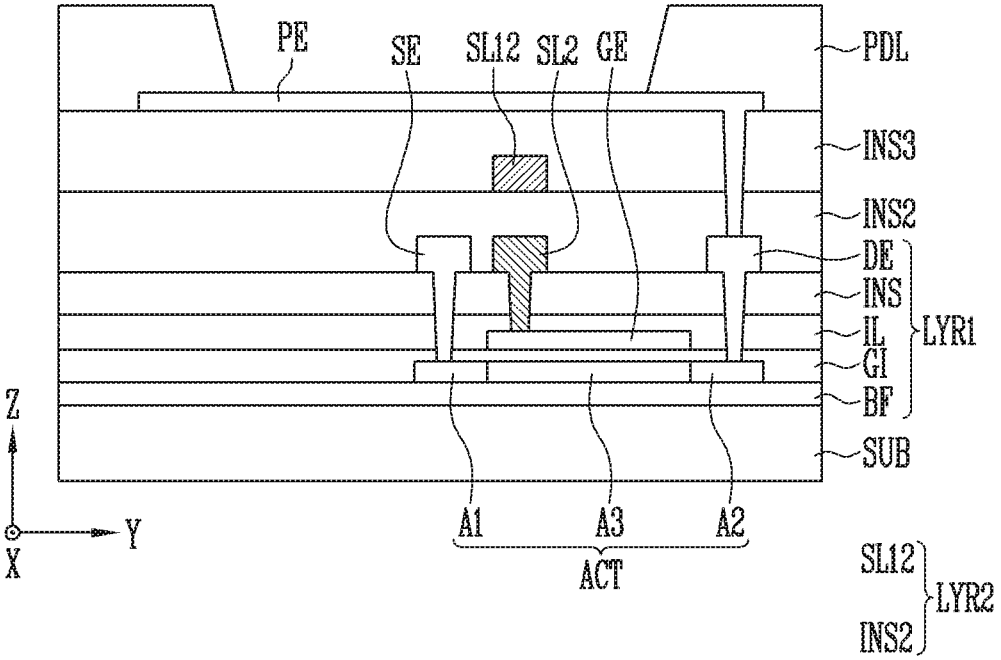
FIG. 5B is a sectional view taken along the line II-II' of FIG. 5A.
Figure 5C:
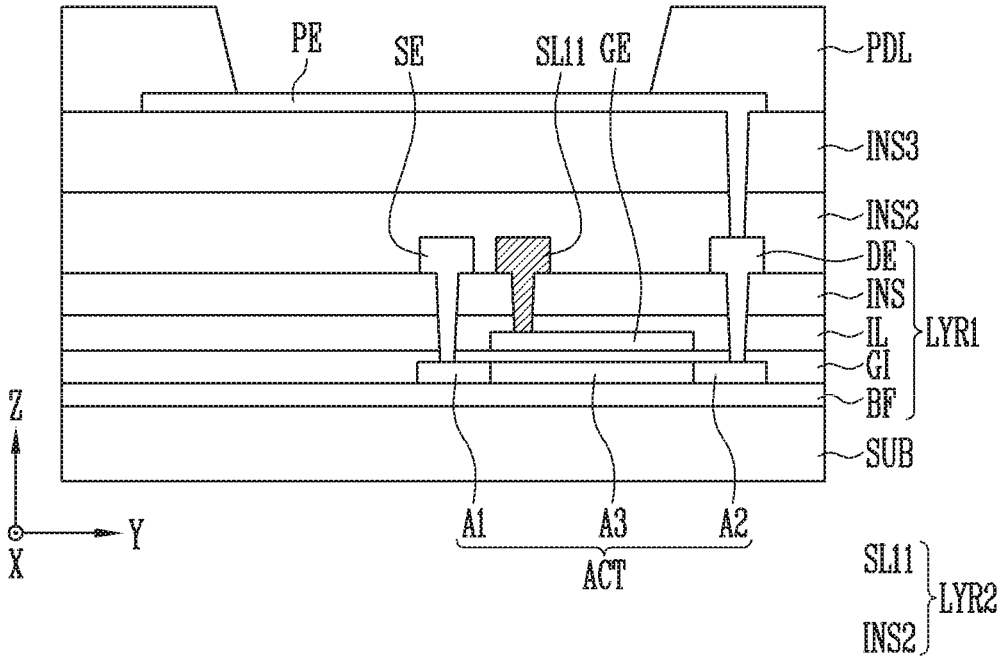
FIG. 5C is a sectional view taken along the line III-III' of FIG. 5A.

FIG. 5A is a schematic sectional view taken along the line I-I' of FIG. 2. FIG. 5B is a sectional view taken along the line II-II' of FIG. 5A, and FIG. 5C is a sectional view taken along the line III-III' of FIG. 5A.

Referring to FIG. 5A, the display device according to the embodiment of the present disclosure includes a substrate SUB, a first layer LYR1 provided on the substrate SUB, and a second layer LYR2 provided on the first layer LYR1. The first layer LYR1 and the second layer LYR2 are schematically illustrated in FIG. 5A. The first layer LYR1 and the second layer LYR2 may be selected among a plurality of layers provided on the substrate SUB, if desired.

Each of the first scan lines SL1 includes a first scan line section SL11 located in the first layer LYR1 and a second scan line section SL12 located in the second layer LYR2. The second scan line section SL12 overlaps with the second scan driver 120 and the second display region DA2. In addition, the first scan line section SL11 and the second scan line section SL12 may be electrically connected to each other through contact holes (i.e., contact openings) CNT1 and CNT2.

The first scan driver 110 and the second scan driver 120 are located in the first layer LYR1, and the second scan lines SL2 are located in the first layer LYR1. As described above, because the second scan driver 120 and the second display region DA2 are located between the first scan driver 110 and the first display region DA1, the first scan lines SL1 overlap with other components. Thus, the second scan line section SL12 that is a portion of each of the first scan lines SL1 is located in the second layer LYR2, which is different from the first layer LYR1 in which the second scan lines SL2 are located.

A portion of the first scan line section SL11 is located between the first scan driver 110 and the second scan driver 120, and a portion of the first scan line section SL11 is electrically connected to one end of the second scan line section SL12 through a first contact hole (i.e., a first contact opening) CNT1. The second scan line section SL12 extends to the first display region DA1 by passing through the second scan driver 120 and the second display region DA2. The other end of the second scan line section SL12 is electrically connected to another portion of the first scan line section SL11. Another portion of the first scan line section SL11 is located in the first display region DA1. The one portion of the first scan line section SL11 and the another portion of the first scan line section SL11 are patterns that are located in the same layer but are separated from each other.

Referring to FIGS. 5B and 5C, the first layer LYR1 may include a buffer layer BF, a source electrode SE, a drain electrode DE, the first scan line section SL11 of the first scan line SL1, and the second scan line SL2. In addition, the second layer LYR2 may include a second insulating layer INS2 and the second scan line sections SL12 of the first scan lines SL1.

The substrate SUB may be made of an insulative material such as glass, resin, and/or the like. Also, the substrate SUB may be made of a material having flexibility to be bendable or foldable. The substrate SUB may have a single- or multi-layered structure.

The buffer layer BF is formed on the substrate SUB. The buffer layer BF prevents or substantially prevents impurities from being diffused into switching and driving transistors. The buffer layer BF may be an inorganic insulating layer made of an inorganic material. For example, the buffer layer BF may be formed of silicon nitride, silicon oxide, silicon oxynitride, or the like. The buffer layer BF may be omitted according to material and process conditions.

An active layer ACT is provided on the buffer layer BF. The active layer ACT is formed of a semiconductor material. The active layer ACT includes a source region A1, a drain region A2, and a channel region A3 provided between the source region A1 and the drain region A2. The active layer ACT may be a semiconductor pattern made of poly-silicon, amorphous silicon, oxide semiconductor, and/or the like.

The gate insulating layer GI is provided on the active layer ACT. The gate insulating layer GI may be an inorganic insulating layer made of an inorganic material. The inorganic material may include inorganic insulating materials such as polysiloxane, silicon nitride, silicon oxide, silicon oxynitride, and/or the like.

The gate electrode GE is provided on the gate insulating layer GI. The gate electrode GE is formed to cover a region corresponding to the channel region A3 of the active layer ACT. The gate electrode GE may be made of a metal. For example, the gate electrode GE may be made of at least one of metals such as gold (Au), silver (Ag), aluminum (Al), molybdenum (Mo), chromium (Cr), titanium (Ti), nickel (Ni), neodymium (Nd), copper (Cu), alloys of said metals, and/or the like. Also, the gate electrode GE may be formed in a single layer. However, the present disclosure is not limited thereto, and the gate electrode GE may be formed in a multi-layer in which two or more materials among the metals and the alloys are stacked.

An interlayer insulating layer IL may be provided over the gate electrode GE. The interlayer insulating layer IL may be an inorganic insulating layer made of an inorganic material. The inorganic material may include polysiloxane, silicon nitride, silicon oxide, silicon oxynitride, and/or the like.

The first insulating layer INS is provided on the interlayer insulating layer IL. The first insulating layer INS may be an inorganic insulating layer made of an inorganic material. The inorganic material may include polysiloxane, silicon nitride, silicon oxide, silicon oxynitride, and/or the like.

The source electrode SE and the drain electrode DE are provided on the first insulating layer INS. The source electrode SE and the drain electrode DE are electrically connected to the source region A1 and the drain region A2 of the active layer ACT through contact holes (i.e., contact openings) formed in the first insulating layer INS, the interlayer insulating layer IL, and the gate insulating layer GI, respectively.

The source electrode SE and the drain electrode DE may be made of a metal. For example, the source electrode SE and the drain electrode DE may be made of metals such as gold (Au), silver (Ag), aluminum (Al), molybdenum (Mo), chromium (Cr), titanium (Ti), nickel (Ni), neodymium (Nd), copper (Cu), alloys of said metals, and/or the like. Also, the source electrode SE and the drain electrode DE may be formed in a single layer. However, the present disclosure is not limited thereto, and the source electrode SE and the drain electrode DE may be formed in a multi-layer in which two or more materials among the metals and the alloys are stacked.

In this embodiment, the first scan line section SL11 of the first scan line SL1 and the second scan line SL2 may be formed of the same or substantially the same material in the same layer as the source electrode SE and the drain electrode DE. The first scan line section SL11 and the second scan line SL2 are electrically connected to the gate electrode through a contact hole (i.e., a contact opening) formed in the first insulating layer INS and the interlayer insulating layer IL.

A second insulating layer INS2 may be provided over the source electrode SE and the drain electrode DE. The second insulating layer INS2 may be an organic insulating layer made of an organic material. The organic material may include organic insulating materials such as a polyacryl-based compound, a polyimide-based compound, a fluorine-based polymer compound including Teflon, a benzocyclobutene-based compound, and/or the like.

The second scan line section SL12 of the first scan line SL1 may be provided on the second insulating layer INS2. The second scan line section SL12 may be formed of the same or substantially the same material as the first scan lines section SL11.

A third insulating layer INS3 may be provided on the second insulating layer INS2 and the second scan line section SL12. The third insulating layer INS3 may be an organic insulating layer made of an organic material.

A pixel electrode PE may be provided on the second insulating layer INS2. The pixel electrode PE is connected to the drain electrode DE through a contact hole (i.e., a contact opening) passing through the third insulating layer INS3 and the second insulating layer INS2, to be connected to a transistor. The pixel electrode PE may be made of a metal layer including Ag, Mg, Al, Pt, Pd, Au, Ni, Nd, Ir, Cr, and/or alloys thereof and/or a transparent conductive layer including tin oxide (ITO), indium zinc oxide (IZO), zinc oxide ZnO, indium tin zinc oxide (ITZO), and/or the like.

A pixel defining layer PDL that exposes the pixel electrode PE therethrough may be provided over the pixel electrode PE. The pixel defining layer PDL may be an organic insulating layer made of an organic material.

Figure 6A:
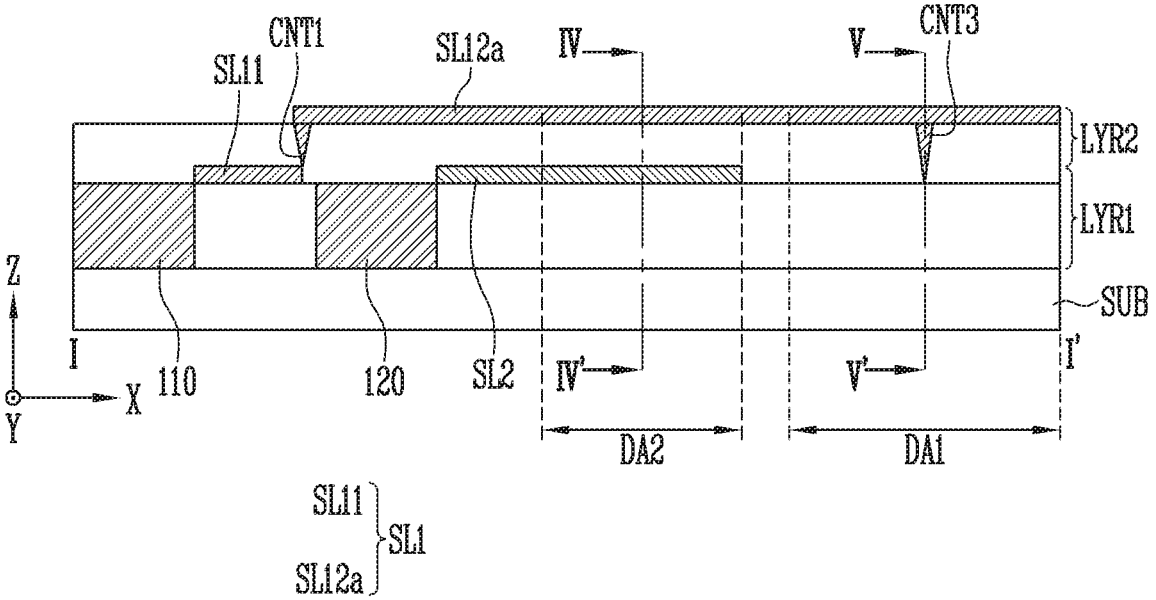
FIG. 6A is a schematic sectional view corresponding to the line I-I' of FIG. 2 in a display device according to another embodiment of the present disclosure.
Figure 6B:
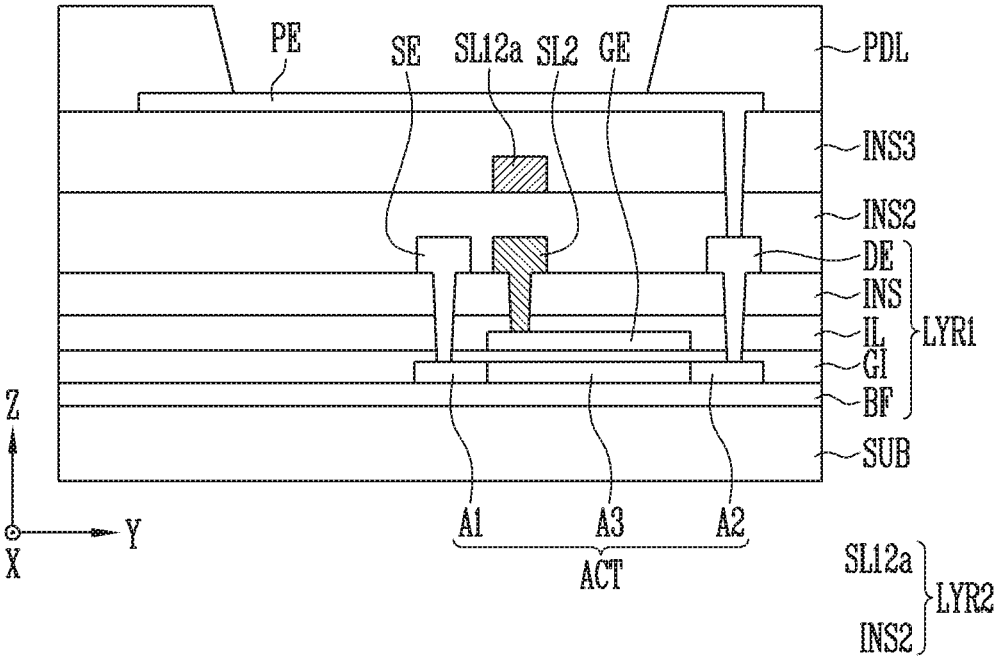
FIG. 6B is a sectional view taken along the line IV-IV' of FIG. 6A.

FIG. 6A is a schematic sectional view corresponding to the line I-I' of FIG. 2 in a display device according to another embodiment of the present disclosure. FIG. 6B is a sectional view taken along the line IV-IV' of FIG. 6A, and FIG. 6C is a sectional view taken along the line V-V' of FIG. 6A.

Figure 6C:
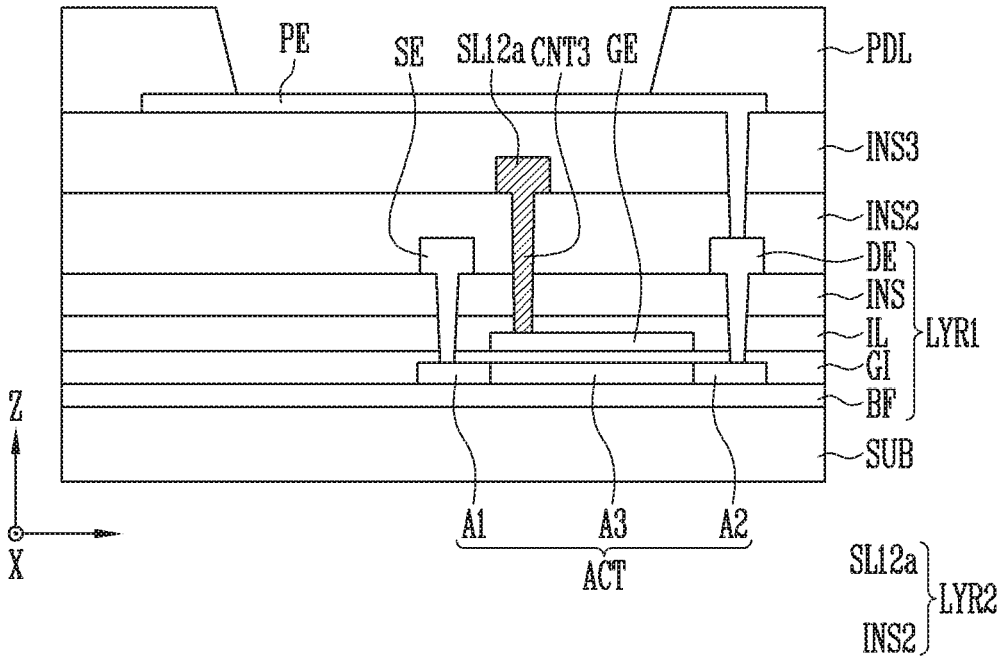
FIG. 6C is a sectional view taken along the line V-V' of FIG. 6A.

Referring to FIGS. 6A, 6B, and 6C, in the display device according to the another embodiment of the present disclosure, a second scan line section SL12*a* of each of the first scan lines SL1 extends up to the first display region DA1. The second scan line section SL12*a* is electrically connected to the first pixels of the first display region DA1 through a third contact hole (i.e., a third contact opening) CNT3.

In this embodiment, the first layer LYR1 may include a buffer layer BF, a source electrode SE, a drain electrode DE, the first scan line section SL11 of the first scan line SL1, and the second scan line SL2. In addition, the second layer LYR2 may include a second insulating layer INS2 and the second scan line sections SL12*a* of the first scan lines SL1.

The second scan line section SL12*a* of the first scan line SL1 may be provided on the second insulating layer INS2. The second scan line section SL12*a* may be formed of the same or substantially the same material as the first scan line section SL11. The second scan line section SL12*a* is electrically connected to the gate electrode GE through the third contact hole CNT3 formed in the second insulating layer INS2, the first insulating layer INS1, and the interlayer insulating layer IL.

Figure 7A:
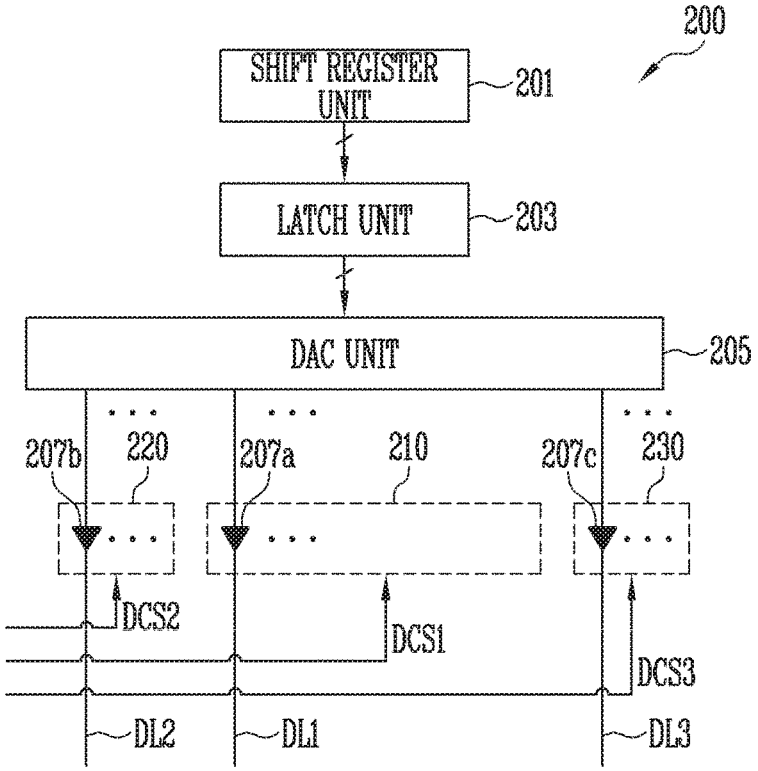
FIG. 7A is a block diagram of a data driver according to an embodiment of the present disclosure.
Figure 7B:
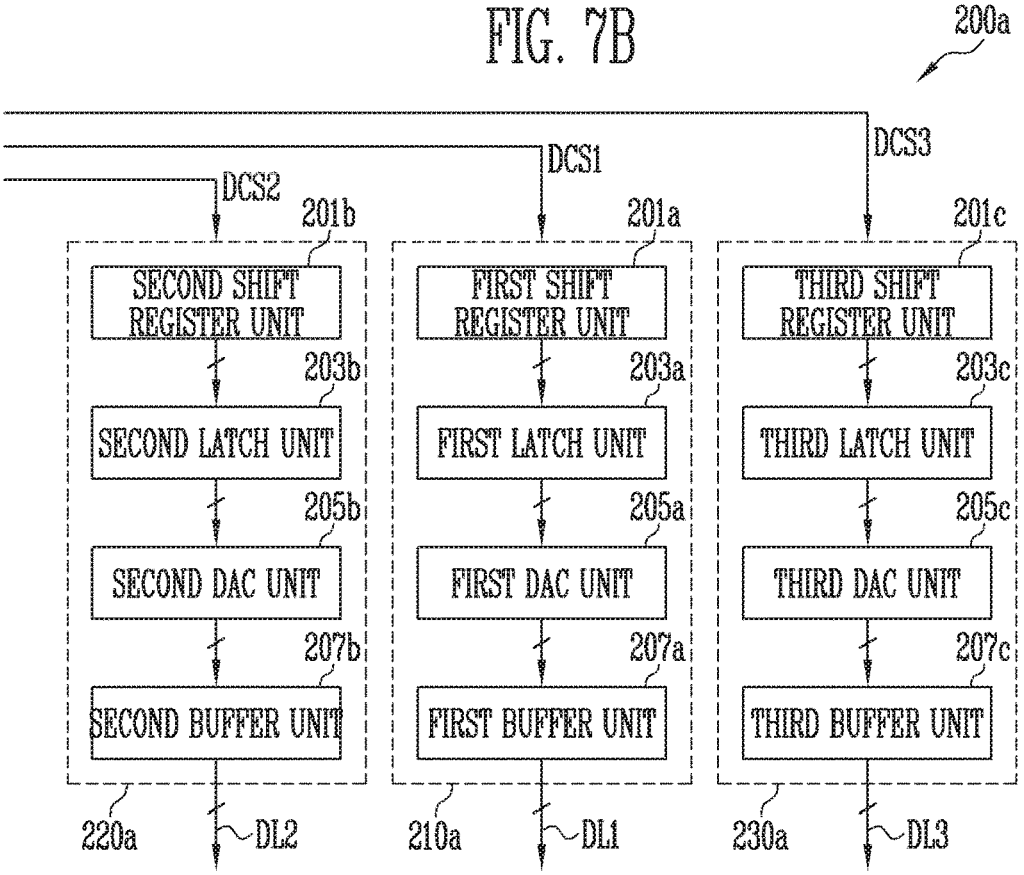
FIG. 7B is a block diagram of a data driver according to another embodiment of the present disclosure.

FIG. 7A is a block diagram of a data driver according to an embodiment of the present disclosure. FIG. 7B is a block diagram of a data driver according to another embodiment of the present disclosure.

Referring to FIG. 7A, the data driver 200 according to this embodiment includes a shift register unit (e.g., a shift register) 201, a latch unit (e.g., a latch) 203, a digital-analog converter (DAC) unit (e.g., a DAC) 205, and first to third drivers 210, 220, and 230.

Each of the first to third drivers 210, 220, and 230 includes a buffer unit (e.g., a buffer). That is, the first driver 210 includes a first buffer unit (e.g., a first buffer) 207*a* connected to the first data lines DL1, the second driver 220 includes a second buffer unit (e.g., a second buffer) 207*b* connected to the second data lines DL2, and the third driver 230 includes a third buffer unit (e.g., a third buffer) 207*c* connected to the third data lines DL3.

The second driver 220 may control power of the second buffer unit 207*b* in response to the second data control signal DCS2. For example, when the low-frequency driving mode is selected, the second driver 220 may allow the power of the second buffer unit 207*b* to be on or off at a partial section in one frame. The third driver 230 operates in the substantially same manner as the second driver 220, and therefore, its description may not be repeated.

According to an example, the second scan driver 220 is driven in the AOD mode in which the frame frequency is 1 Hz. The frame frequency of the second driver 220 is synchronized with 1 Hz such that the second driver 220 outputs, once for every frame, a data signal to the second data lines DL2. The second driver 220 allows the power of the second buffer unit 207*b* to be off during the remaining period. Although the power of the second buffer 207*b* is off, the second display region DA2 outputs a still image.

Referring to FIG. 7B, the data driver 200 according to this embodiment includes first to third drivers 210*a*, 220*a*, and 230*a*, and each of the first to third drivers 210*a*, 220*a*, and 230*a* includes a shift register unit, a latch unit, a DAC unit, and a buffer unit.

In an embodiment, the first driver 210*a* includes a first shift register unit (e.g., a first shift register) 201*a*, a first latch unit (e.g., a first latch) 203*a*, a first DAC unit (e.g., a first DAC) 205*a*, and a first buffer unit (e.g., a first buffer) 207*a*. The second driver 220*a* includes a second shift register unit (e.g., a second register) 201*b*, a second latch unit (e.g., a second latch) 203*b*, a second DAC unit (e.g., a second DAC) 205*b*, and a second buffer unit (e.g., a second buffer) 207*b*. The third driver 230*a* includes a third shift register unit (e.g., a third shift register) 201*c*, a third latch unit (e.g., a third latch) 203*c*, a third DAC unit (e.g., a third DAC) 205*c*, and a third buffer unit (e.g., a third buffer) 207*c*.

The second driver 220*a* may control power of the second shift register unit 201*b*, the second latch unit 203*b*, the second DAC unit 205*b*, and the second buffer unit 207*b* in response to the second data control signal DCS2. According to an example, the second scan driver 120 is driven in the AOD mode in which the frame frequency is 1 Hz. The frame frequency of the second driver 220*a* is synchronized with 1 Hz such that the second driver 220*a* outputs, once for every frame, a data signal to the second data lines DL2. The second driver 220*a* allows the power of the second shift register unit 201*b*, the second latch unit 203*b*, the second DAC unit 205*b*, and the second buffer unit 207*b* to be off during the remaining period. Although power of the second driver 220*a* is off, the second display region DA2 outputs a still image. The third driver 230*a* operates in the substantially same manner as the second driver 220*a*, and therefore, its description may not be repeated.

As described above, according to the present disclosure, some of the first scan lines corresponding to the first display region and the second scan lines corresponding to the second display region are located in different layers, so that the second display region can be independently driven. As a result, power consumption can be reduced as the second display region is driven at a low frequency.

Example embodiments have been disclosed herein, and although specific terms are employed, they are used and are to be interpreted in a generic and descriptive sense, and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various suitable changes in form and details may be made without departing from the spirit and scope of the present disclosure as defined the following claims, and equivalents thereof.

What is claimed is:

1. A display device comprising:

a first display region comprising a plurality of first pixels connected to first scan lines and first data lines;

a second display region at one side of the first display region, the second display region comprising a plurality of second pixels connected to second scan lines and second data lines;

a first scan driver configured to supply a scan signal to the first scan lines;

a second scan driver between the second display region and the first scan driver, the second scan driver being configured to supply a scan signal to the second scan lines; and a data driver configured to supply a data signal to the first data lines and the second data lines, wherein at least some of the first scan lines and the second scan lines are at different layers, wherein each of the first scan lines comprises:

a first scan line section of first scan line sections at a first layer; and a second scan line section of second scan line sections at a second layer on the first layer, and wherein the second scan line section overlaps with the second scan driver and the second display region, and wherein portions of the first scan line section are at opposite sides of at least one of the second scan lines.

2. The display device of claim 1, wherein the second scan lines are at the first layer.

3. The display device of claim 1, wherein the first scan line section and the second scan line section are electrically connected to each other through a contact opening.

4. The display device of claim 1, wherein the first scan driver and the second scan driver are at the first layer.

5. The display device of claim 1, wherein the first layer comprises a buffer layer, an active layer, a gate insulating layer, a gate electrode, a first insulating layer, a source electrode, a drain electrode, the first scan line sections of the first scan lines, and the second scan lines.

6. The display device of claim 1, wherein the second layer comprises a second insulating layer and the second scan line sections of the first scan lines.

7. The display device of claim 1, further comprising a controller configured to control the first scan driver and the second scan driver to be driven at different frame frequencies.

8. The display device of claim 7, wherein, when a low-frequency driving mode is selected, the controller is configured to control the first scan driver to be driven at a first frame frequency, and to control the second scan driver to be driven at a second frame frequency lower than the first frame frequency.

9. The display device of claim 8, wherein the low-frequency driving mode is an always on display (AOD) mode in which a still image is always displayed in at least one of the first and second display regions.

10. The display device of claim 1, wherein the data driver comprises:

a first driver corresponding to the first display region; and a second driver corresponding to the second display region.

11. The display device of claim 10, wherein a frame frequency of the second driver is synchronized with that of the second scan driver, and wherein the second driver is configured to supply the data signal.

12. The display device of claim 11, wherein the second driver comprises a buffer connected to the second data lines, wherein, when a low-frequency driving mode is selected, power of the buffer is off at a partial section in one frame.

13. The display device of claim 12, wherein the second driver further comprises a shift register, a latch, and a digital-analog converter (DAC).

14. The display device of claim 1, further comprising:

a third display region at an other side opposed to the one side of the first display region, the third display region comprising a plurality of third pixels connected to third scan lines and third data lines; and a third scan driver at the other side of the third display region, the third scan driver being configured to supply a scan signal to the third scan lines.

15. The display device of claim 14, wherein the data driver further comprises a third driver corresponding to the third display region.

16. The display device of claim 1, further comprising:

a fourth display region between the first display region and the data driver, the fourth display region comprising a plurality of fourth pixels connected to fourth scan lines and the first data lines; and a fifth display region opposite to the fourth display region, the fifth display region comprising a plurality of fifth pixels connected to fifth scan lines and the first data lines.

17. A display device comprising:

a first display region comprising a plurality of first pixels connected to first scan lines and first data lines;

a second display region at one side of the first display region, the second display region comprising a plurality of second pixels connected to second scan lines and second data lines;

a first scan driver configured to supply a scan signal to the first scan lines;

a second scan driver between the second display region and the first scan driver, the second scan driver being configured to supply a scan signal to the second scan lines; and a data driver configured to supply a data signal to the first data lines and the second data lines, wherein at least some of the first scan lines and the second scan lines are at different layers, wherein each of the first scan lines comprises:

a first scan line section at a first layer; and a second scan line section at a second layer on the first layer, and wherein the second scan line section overlaps with the second scan driver and the second display region, and wherein the second scan line section overlaps with the first display region.

* * * * *